United States Patent [19]

Ostor

[11] Patent Number: 5,052,144

[45] Date of Patent: Oct. 1, 1991

[54] GRENADE LAUNCHER

[76] Inventor: Pierre A. Ostor, 70 NE. 63rd Way, Fridley, Minn. 55432

[21] Appl. No.: 271,592

[22] Filed: Nov. 14, 1988

[51] Int. Cl.[5] ..... F41C 27/06

[52] U.S. Cl. ..... 42/105; 42/17

[58] Field of Search ..... 42/105, 17, 75.03, 6

[56] References Cited

U.S. PATENT DOCUMENTS

| | | | |
|---|---|---|---|
| 2,748,518 | 6/1956 | Moran | 42/105 |
| 3,243,909 | 4/1966 | Kotikov | 42/105 |
| 3,404,477 | 10/1968 | Silsby | 42/105 |
| 3,435,549 | 4/1969 | Kermode | 42/17 |
| 3,538,635 | 11/1970 | Friend | 42/10 |
| 3,548,709 | 12/1970 | Prince | 89/149 |
| 3,566,527 | 12/1970 | Silsby | 42/105 |
| 3,608,422 | 9/1971 | Bretnor | 42/105 |
| 3,611,867 | 10/1971 | Silsby | 89/14.05 |
| 3,864,862 | 2/1975 | Brunger et al. | 42/105 |
| 3,919,799 | 11/1975 | Austin, Jr. et al. | 42/105 |
| 4,019,424 | 4/1977 | Reyolds | 42/105 |
| 4,156,981 | 6/1979 | Lusk | 42/105 |
| 4,689,912 | 9/1987 | Gillum | 42/105 |

*Primary Examiner*—David H. Brown

*Attorney, Agent, or Firm*—Leo Gregory

[57] ABSTRACT

A hand operated grenade launcher having a multiple round disposable magazine, having the magazine forming an extension of the barrel in cooperatively positioning a cartridge in firing position, having a pump action barrel travel a shorter distance than a cartridge length and having an automatic advancement and ejection of the magazine.

9 Claims, 6 Drawing Sheets

GRENADE LAUNCHER

BACKGROUND OF THE INVENTION

1. Field of Invention

This invention relates to a grenade launcher.

2. Brief Description of The Previous Art

This invention relates to a multiple round grenade launcher. The use of grenade projectiles has developed into a fairly widespread application for law enforcement as well as for war time effort.

The generally used grenade launchers deal with low velocity single shot type of weapons designed to use a specific type of cartridge. The launchers using magazines for multiple shot purposes generally require that the magazines be manually loaded and for the most part in launchers, the spent cartridge casings must first be manually removed from the magazine before reloading.

SUMMARY OF THE INVENTION

This invention embodies improvements in several aspects.

It is a basic object herein to provide a manually operated grenade launcher which will deliver maximum fire power with a reduced overall dimension.

It is another object to provide a grenade launcher structure in which the barrel is slidable into the receiver and the receiver is pivoted to break open the weapon.

It is another object herein to have a disposable magazine holding a plurality of cartridges and movable transversely of the receiver being advanced by the pumping action of the barrel and being automatically ejected.

It is a further object of this invention to have the magazine function as an extension of the barrel in holding a cartridge, the barrel holding the nose portion of the projectile and an adjacent portion of the casing with the rest of the casing being contained in the magazine.

It is also an object of this invention to achieve a reduced length of a grenade launcher by containing most of the casing of the cartridge within the magazine and having the pumping action of the barrel be for a distance but little more than the length of the portion of the projectile extending outwardly of the casing.

It is also an object herein to provide a grenade launcher in which a multiple shot containing magazine is advanced very rapidly by a relatively short pumping action of the barrel and this short pumping action results in a relatively fast firing operation.

It is a further object herein to provide a grenade launcher which will not be limited to one specific designated cartridge or ammunition but which will accept a variety of types of ammunition such as smoke rounds, gas rounds, lightening rounds and the like.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in perspective on an enlarged scale;

DESCRIPTION OF A PREFERRED EMBODIMENT

Figure 2:
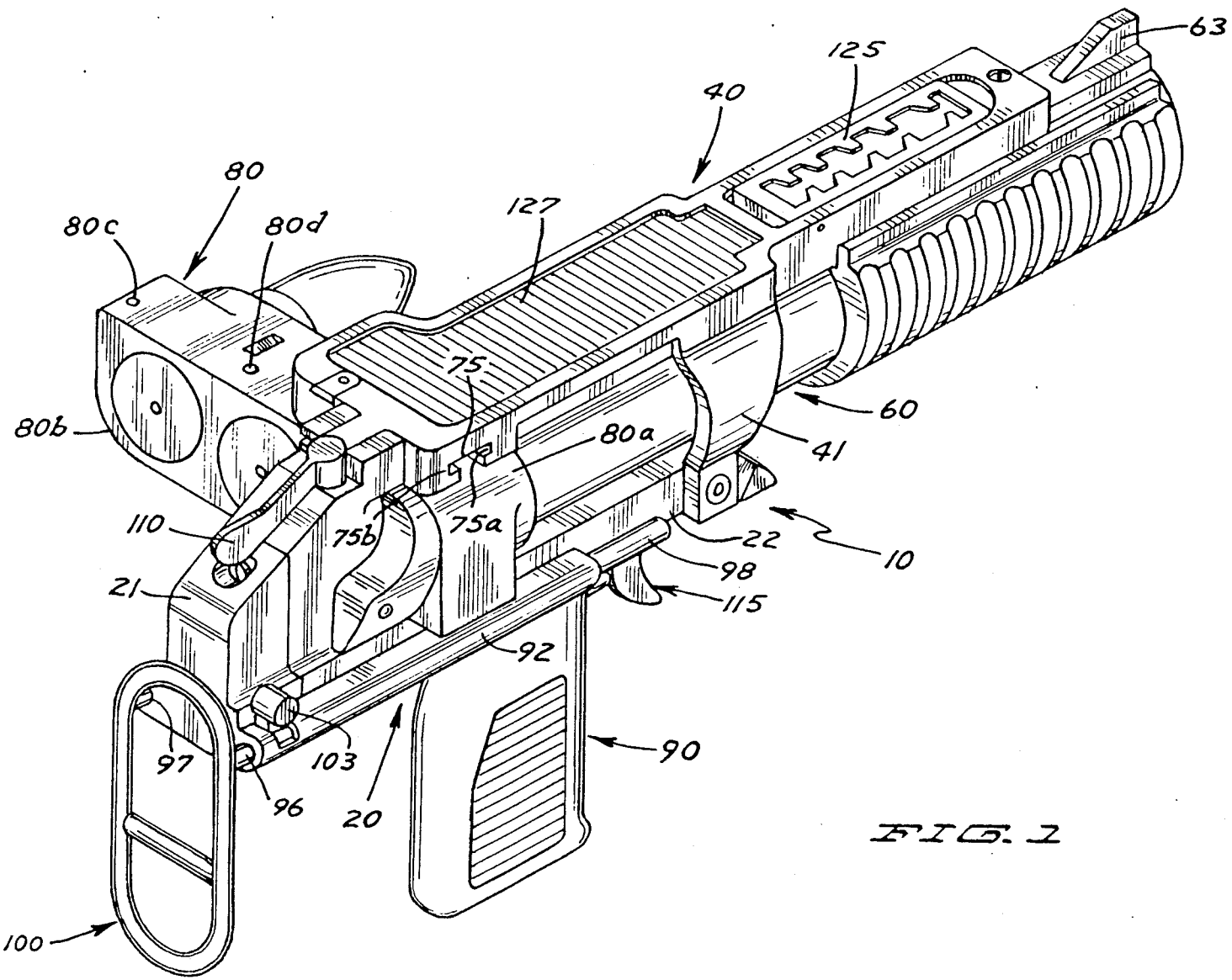
FIG. 2 is a view in side elevation on an enlarged scale showing in dotted line a portion thereof in an alternate position.
Figure 2:
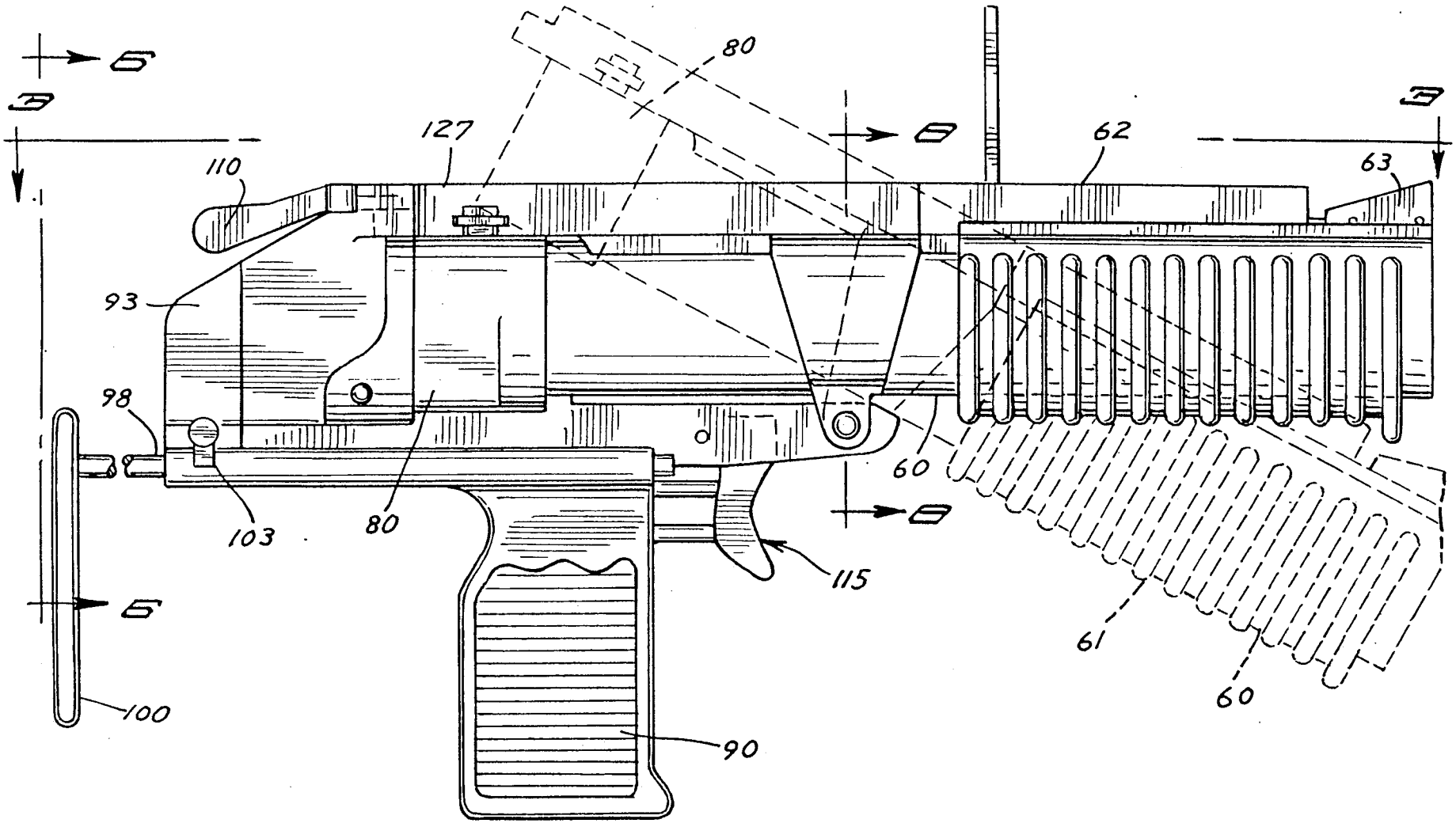

Referring to the drawings, the structure of the grenade launcher which makes up the invention herein is indicated generally by the reference numeral 10.

The major components of said launcher are a lower receiver 20, an upper receiver 40, a barrel 60, a magazine 80, a grip 90, a stock 100 and a trigger arrangement 115.

The lower receiver 20 is formed as an elongated plate member having an upwardly angled rearward body portion 21 whereby this portion of the lower receiver in cross section is on the order of an inverted T and the same will be further described.

Spaced above said lower receiver and extending forwardly thereof is an upper receiver 40. Extending downwardly from said upper receiver substantially intermediate the ends thereof are a pair of spaced opposed arcuate fairly narrow tapered side wall portions 41 and 42 which have parallel depending lower end portions **41*a* and 42*a* which engage and are pivoted to the forward end portions 22 and 23 of said lower receiver by suitable pivots 24** as shown.

Said depending side wall portions define a space therebetween cylindrical in cross section to accommodate said barrel 60 extending therethrough, as will be described.

Said barrel will be positioned between said upper and lower receivers extending forwardly thereof and being retained, as will be described, by the upper receiver in the area thereof where it is pivoted to the lower receiver.

Figure 5:
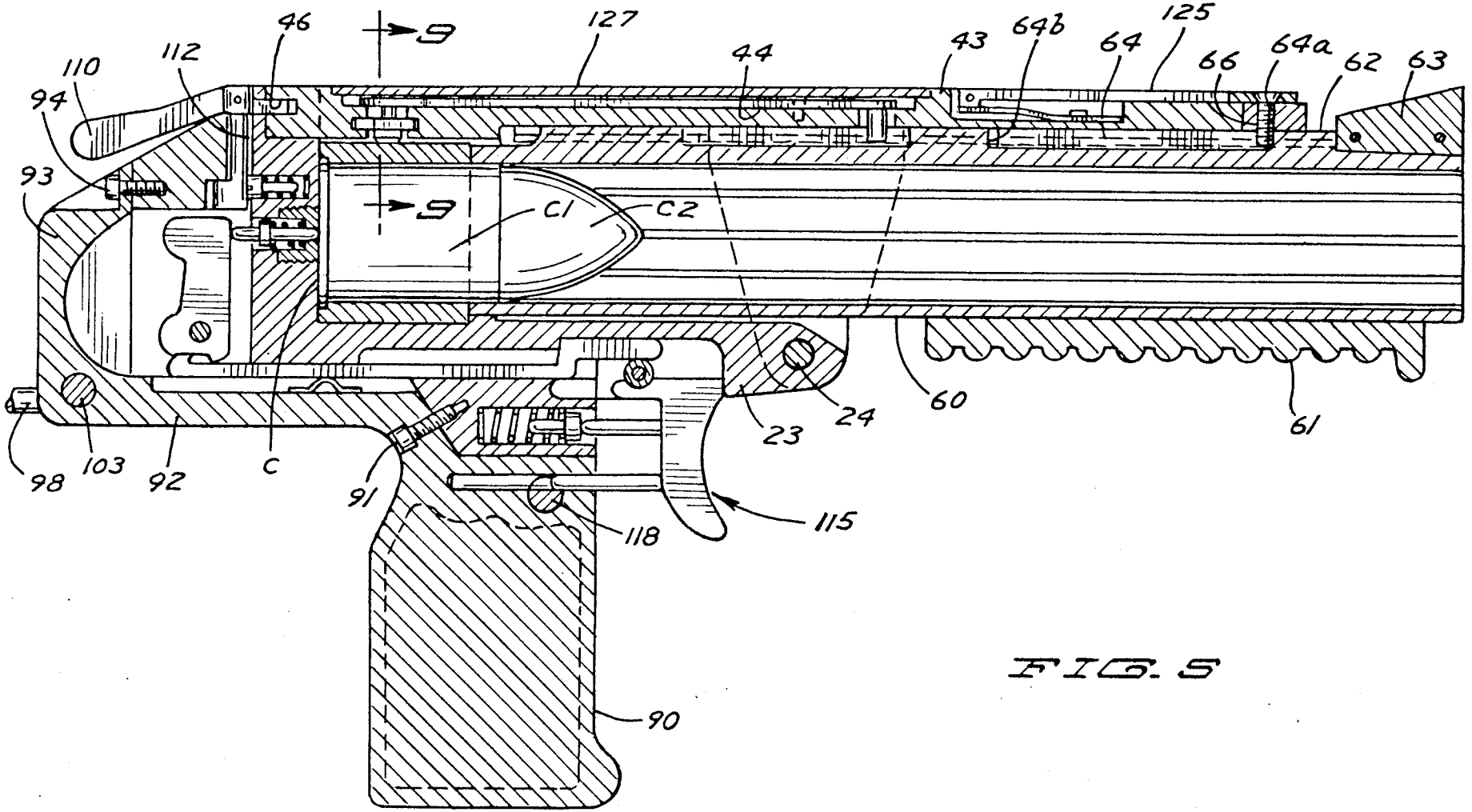
FIG. 5 is a view in vertical section taken on line 5—5 of FIG. 3.
Figure 7:
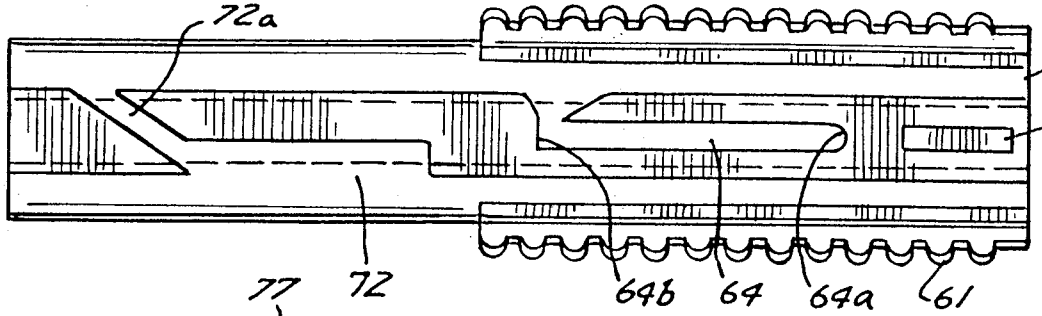
FIG. 7 is a top plan view of a portion of the barrel.
Figure 8:
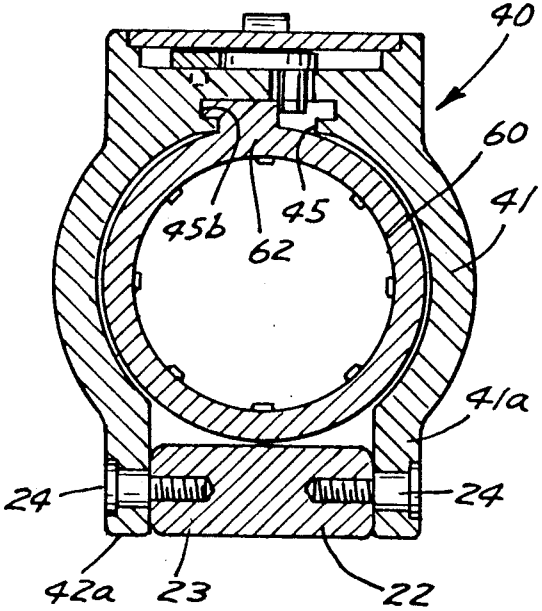
FIG. 8 is a view in vertical section taken on line 8—8 of FIG. 2 as indicated.

As will be noted as in FIG. 5, the top wall 43 of the upper receiver has some thickness and within the upper inside surface portion 44 thereof, there is formed relative to said barrel, an overhead T-shaped track 45 as seen in FIG. 8.

Disposed to be slidably carried in said track is said barrel 60. Said barrel lends itself to a convenient use of said launcher by having the relatively short length of only some 15 inches and by having a short linear pumping or travel distance being just somewhat greater than the distance a projectile and an adjacent portion of its casing extend into the barrel beyond its magazine as will be further described. The short length of the barrel and short linear pumping action represent significant improvement over prior art like weapons.

For gripping purposes, said barrel is shown having a transversely convoluted hand hold or guard 61 of suitable material formed about the lower forward portion of said barrel.

Extending lengthwise of the upper mid portion of said barrel is a raised track 62 having some portions thereof T-shaped in cross section and which is adapted to be disposed in said track portion 45 to be carried thereby as shown in FIG. 8. Said track has several operational portions as will be described.

Suitably mounted upon the upper forward tip portion of said track is a front sight 63.

Said track has an open top slot 64 therein which extends from the point 64*a* to 64*b* and this is the linear distance which the barrel is able to travel and a stop limit member 66 in the form of a screw extends downwardly from said upper receiver into said slot and defines the travel limits of the barrel.

Inserted into said barrel track facing the inner end of said slot is a tough wearing metal stop member 67 which forms an abutment for a latch member 69. Said latch member 69 is pivoted by a pivot 68 to the overhead wall 62 of said upper receiver for a lateral or swinging movement into and out of said track portion 45*b* as seen at the left side of the barrel as viewed in FIGS. 3 and 4. Said latch member has end portions 69*a* and 69*b*.

A coil spring 70 is secured in said latch adjacent the end portion thereof 69*a* and extends outwardly thereof to bear against the adjacent wall of said track and normally urge said end portion to be outwardly of said track and cause said end portion 69*b* thereof to swing inwardly of said track to engage the stop member 67 and thus limit the rearward movement of the barrel 60.

Next will be described the magazine 80 and its relationship to the barrel 60 as an operational extension thereof.

The magazine 80 which is expendable and disposable is shown here adapted to carry three cartridges or three rounds C. Recommended for use here is a 40 m/m cartridge. Said magazine may be molded of plastic or made of lightweight metal. Said magazine is substantially parallelepiped in form having a radius 80*a* at its leading top edge portion and a radius 80*b* at its diagonally opposed trailing edge portion. The magazine has in its upper or top side 81 three spaced holes 80*c*, 80*d* and 80*e* which are locator holes to align the cartridge with the barrel and also in said top side are angled notches 80*f* and 80*g* for the advancement of the magazine. The notches have a vertical front wall and an inclined rear wall as indicated at 80*h* and 80*i*. The magazine is loaded from the left of the launcher as seen in FIG. 1. Although the bottom of the magazine is not shown, it is reversible with the top side shown, reversed end to end.

At the rear of the barrel 60, said upper and lower receivers are configured to form a channel 82 to receive said magazine. The magazine contains the cartridge casing C1 as shown in FIG. 5 and the nose portion C2 of the projectile therein and an adjacent portion of its casing extending forwardly of the magazine are received into the barrel 60. Thus there is this operational relationship between the magazine and the barrel, the magazine in effect forms an extension of the barrel. This makes unnecessary any breach in the weapon and simplifies its construction.

Figure 3:
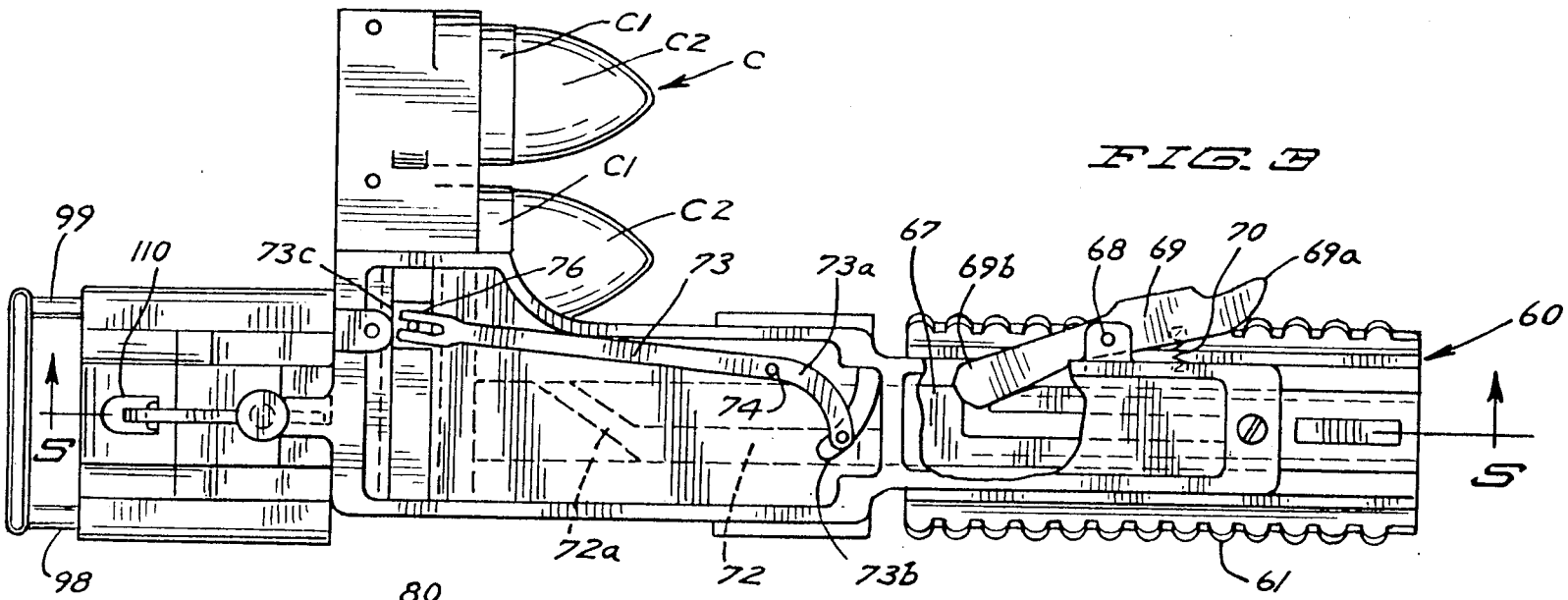
FIG. 3 is a top plan view taken on line 3—3 of FIG. 2 and showing some parts in dotted line and portions thereof broken away.

Next will be described the elements which cause the transverse movement of the magazine as the weapon is fired. Referring again to the track 62, to the rear of said stop member 67, a section of said track 62 is formed to be recessed as at 72 terminating in an angled inclination 72*a* forming a ramp (FIG. 3).

Figure 4:
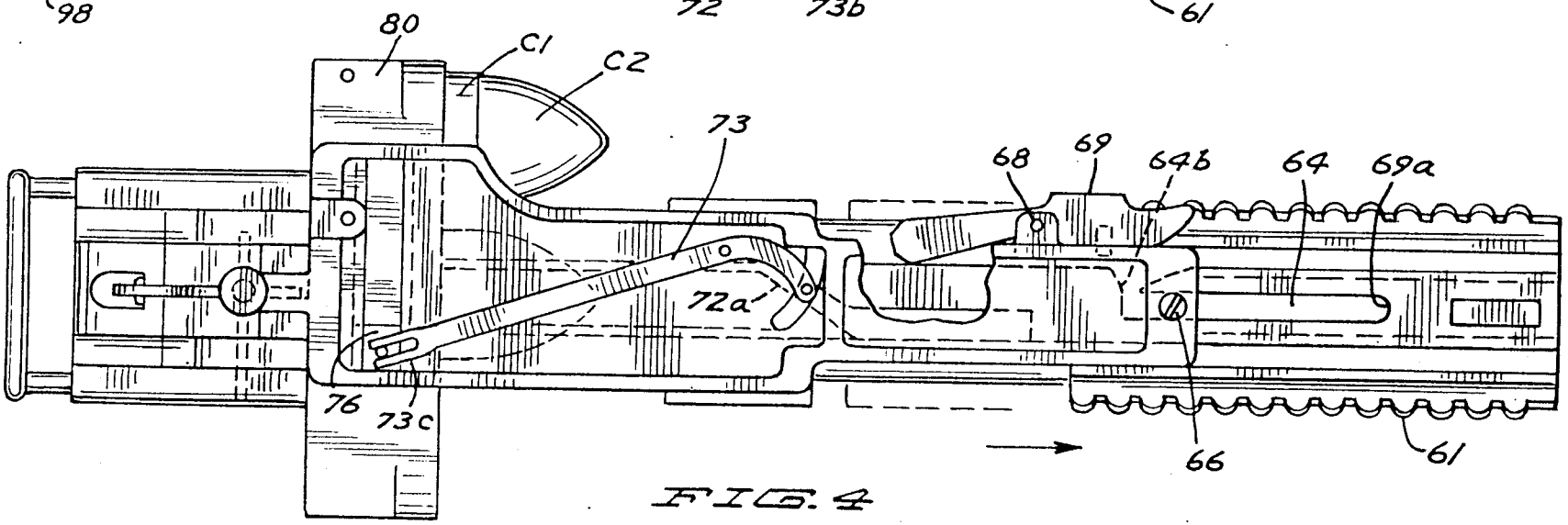
FIG. 4 is a view similar to that of FIG. 3 showing some parts in an alternate position.

An action bar 73 is pivoted to the overhead wall of the upper receiver by a pivot 74. The bar is pivoted adjacent an arcuate or curved forward end portion 73*a* thereof which has a depending cylindrical roller 73*b* pivoted to the outer end thereof which extends into said track section 72. The rearward remainder of said action bar 73 is straight having a bifurcated end 73*c* forming an open ended slot. It is seen that with the action bar pivoted to the stationery over head receiver, that the barrel when being moved or pumped forwardly causes the roller 73*b* to be guided by said slot 72 and its angled portion 72*a* and causes the bifurcated portion to swing to the right as shown in FIGS. 3 and 4.

Next will be described the mechanism operated by said action bar 73 to advance and eject said magazine.

Formed in the upper receiver above the magazine, when in position, is a transverse channel 75 having opposing walls having facing slots 75*a* and 75*b* therein in which slides a carrier plate member 76. An L-shaped carrier finger 76*a* has its shorter angled portion 76*b* recessed into a slot 76*d* into which it is pivoted by a pin 76*e*. Secured into the bottom wall of said plate member 76 is a compression spring 76*f* which bears against the longer angled portion 76*a* of said carrier finger and urges it downwardly to engage the facing upper surface of a magazine. Upstanding from said plate member 76 is a post 76*g* which is received into the bifurcated portion 73*c* of said action bar 73. Said carrier finger has beveled sidewalls, not here shown, for ease of a magazine to pass under the same. The operation here will be described hereinafter.

Figure 10:
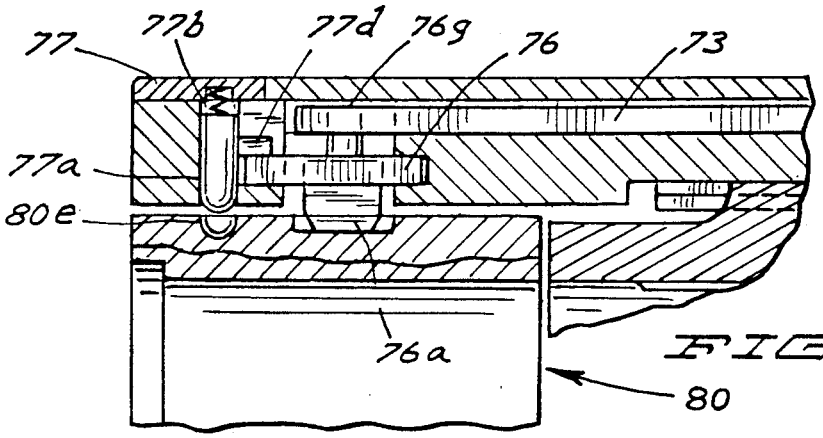
FIG. 10 is a view in vertical section taken on line 10—10 of FIG. 9 as indicated.
Figure 11:
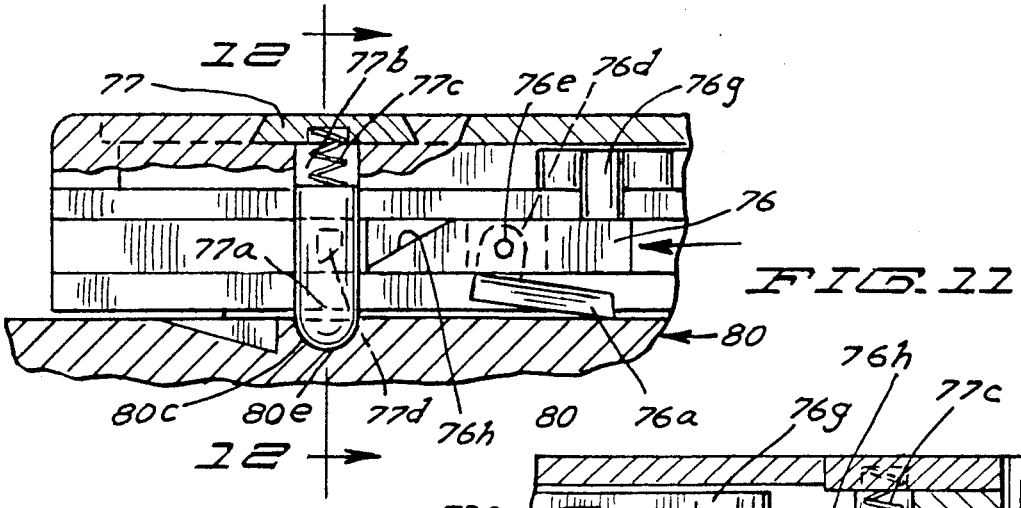
FIG. 11 is a broken view in vertical section showing a detail of structure.
Figure 12:
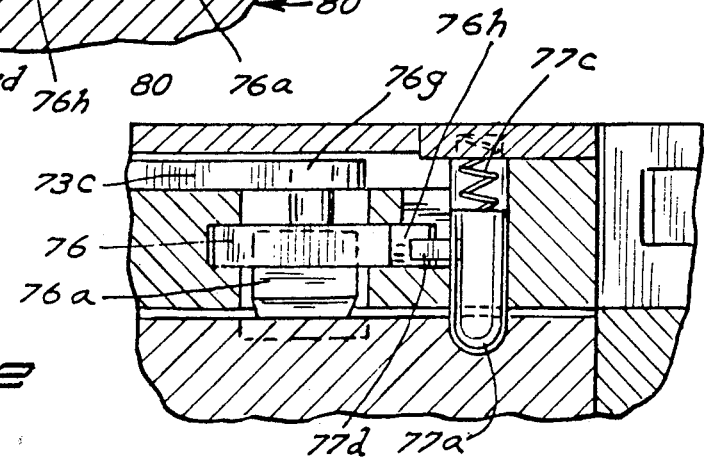
FIG. 12 is a view in vertical section taken on line 12—12 of FIG. 11 as indicated.

To locate a magazine to have its rounds line up with the barrel in firing position, a locating pin 77*a* is provided partially recessed into a recess 77*b* of a retaining plate 77 which is suitably secured to the overlying wall of said top receiver, as indicated in FIGS. 10 and 11. Said pin has an overlying compression spring 77*c* which urges said pin downwardly. Said pin has a projecting ledge 77*d*.

The carrier plate member 76 as indicated in FIG. 11 has at one side thereof a downwardly beveled ramp portion 76*h* which is in alignment with said ledge. Said locating pin is anchored as to any transverse or horizontal movement. Said carrier plate in being moved to the left, as viewed in FIG. 11, has its ramp portion 76*h* engage said ledge 77*d* and raises it and said pin 77*a* upwardly just out of engagement with the top surface of the underlying magazine. Otherwise said pin will engage the upper surface of an underlying magazine and as one of the holes of said magazine such as 80*e* passes under the pin, the pin is urged into said hole and thus positions the magazine to have the next round to be fired to be aligned with the barrel 60 to be received thereinto. Said retaining plate is positioned spaced from the axis of the barrel whereby the locating pin properly aligns the rounds in the magazine with the barrel.

Figure 6:
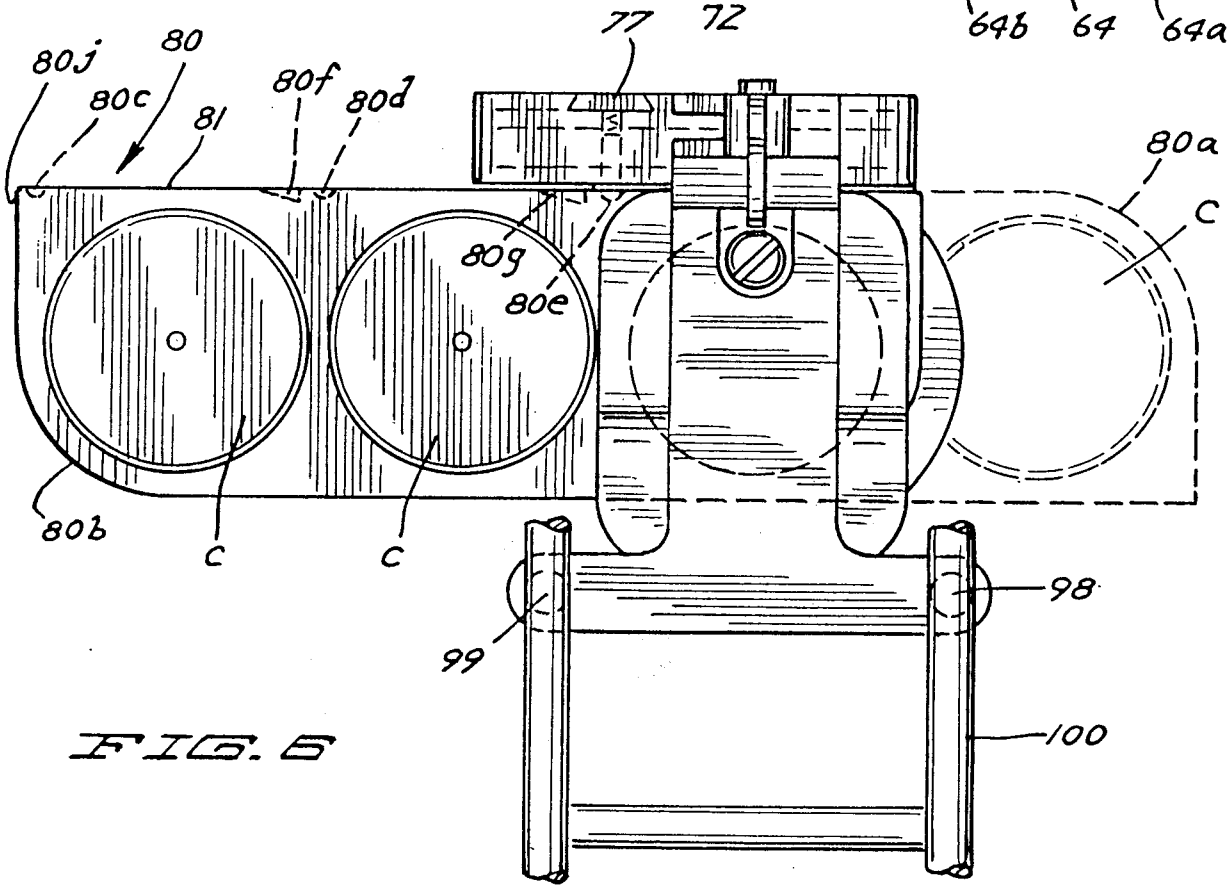
FIG. 6 is a view in end elevation taken on line 6—6 of FIG. 2 as indicated.
Figure 9:
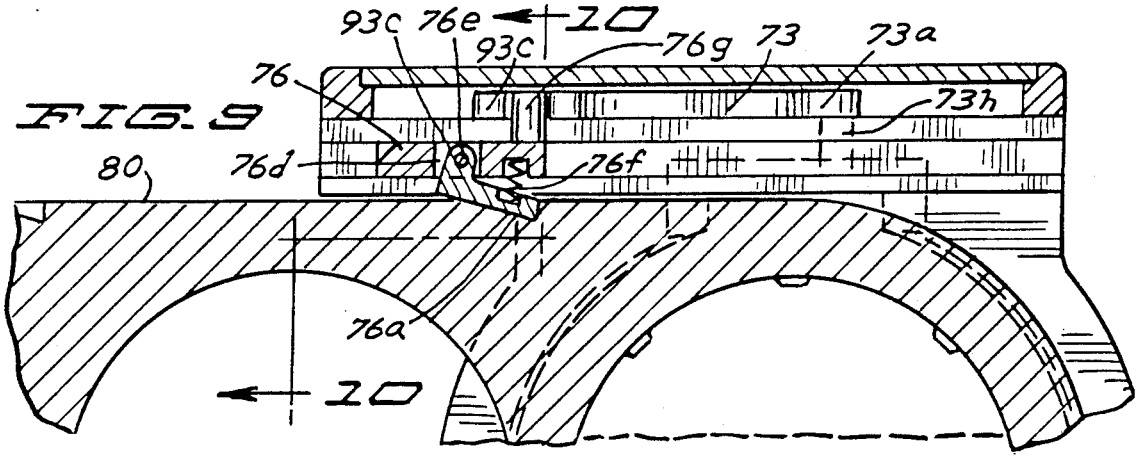
FIG. 9 is a view in vertical section taken on line 9—9 of FIG. 5.

A conventional type of grip 90 is provided mounted as shown in FIGS. 1 and 5 having the grip portion secured by a screw 91 secured into the lower receiver and having a widened plate portion 92 underlying the rearward portion of the lower receiver and as indicated clearly in FIGS. 1, 2 and 6 having an upward extending rear portion 93 secured by a screw 94 to the adjacent part of the upper receiver. Said plate portion 92 has a pair of spaced channels 96 and 97 into which are extensibly disposed rods 98 and 99 having at their outer end a tubular support member or shoulder piece 100 forming a stock. A spring loaded locking pin 103 can be released by pressure to permit the extension or retraction of said stock.

A locking key 110 is pivoted at 112 to the upper portion 93 of the grip 90 and has a projecting finger 113 slidable into and out of a horizontal slot 46 of said upper receiver 40. When the key is engaged in said slot, the upper receiver is locked against any upward pivotal movement.

The triggering mechanism 115 is fairly conventional and is described as having a double action with hammer rebound, a retractable firing pin and geared trigger. A manual safety locking pin 118 is provided. It is believed that no further description of the firing mechanism is required.

Overlying the upper front end portion of the upper receiver is mounted a conventional adjustable plate type rear sight 125. Over the remaining upper portion of said upper receiver 40 is suitably secured a protective plate member 127 referred to as a dust cover.

OPERATION

It is seen that the launcher herein does not have a bolt structure but utilizes a simpler arrangement of a disposable magazine serving as an extension of the barrel seating the cartridge by a cooperative arrangement.

The barrel has only a short linear movement and if pivotally raised is done so only with the pivotal raising of the upper receiver.

Now, as to the loading of ammunition which is standard for the launcher, the barrel is first pumped or moved forwardly by grasping the hand hold 61 and sliding the barrel forwardly to the extend permitted by the stop member 66.

As the barrel is moved forwardly, the action bar 73 by the rail arrangement on the barrel is caused to have its bifurcated end 73*c* move the carrier plate 76 to the left of the channel 75 and the carrier plate 76 has its ramp 76*h* which engages the ledge 77*e* of the locating pin to raise it as has been described.

A magazine 80 is inserted into the channel 82 from the left side of the launcher. The carrier finger 76*a* is downward but is raised by engagement of the rounded leading upper edge of the magazine so that it rests upon the upper surface of the magazine.

As the barrel is retracted, the action bar is caused to be moved to the right when the magazine is inserted into said slot 82. The magazine is inserted sufficiently so that when the barrel is retracted, the carrier finger 76*a* drops into the first notch 80*g* of the magazine passing thereunder and the continued retraction of the barrel continues the movement of the magazine to the right to place the first round of the magazine in firing position. The retraction of the barrel is timed to receive therein the extended part C2 of the cartridge and the edge portion of the casing C1. The barrel is retracted to being in engagement with the adjacent side wall of the magazine. As the magazine is being moved to the right by the action bar and passes under the locating pin 77*a*, the pin drops into the hole 80*e*, being the first hole to pass under said locating pin and this positions and holds the magazine to have the first round aligned with the barrel. The nose of the (projection C2) is rounded and thus as the barrel is retracted it of itself may also engage the side of the nose C2 of the projectile as the locating pin drops or is about to drop into its respective hole. This timing and alignment works out very well.

When the first round is fired, in preparation for the next round, the barrel is moved or pumped forwardly which causes the action bar 73 to have its bifurcated end 73*c* move to the left which in turn moves the carrier plate member 76 of which its beveled edge or ramp 76*h* engages and raises the ledge 77*e* and its locating pin out of its hole 80*e* in the magazine.

Then as the barrel is retracted, the action arm having swung left to its extent, is reversed and is swung to the right having the carrier finger 76*a*, as it slides along the top surface of the magazine, drop into and engage the second notch 80*f* of the magazine and thus moves the magazine to the right to align the second round therein with the barrel as above described.

In like manner the third round is prepared and fired. Here, in lieu of the carrier finger dropping into a notch such as 80*f*, it drops behind the wall edge 80*j* and with the movement of the bifurcated arm portion 73*c* to the right, it is moved to the right moving the magazine with it to align the third round with the center of the barrel and the same is done as the locater pin drops into the third hole 80*c*.

When the third round is fired, the barrel is pumped forward and the notched end 73*c* of the arm 73 moves the magazine 80 to the right to the extent of ejecting it.

Thus upon the magazine being ejected, the retraction of the barrel causes the action arm to repeat the action above described from the time of insertion of the magazine 80.

The structure upon being understood is seen to be simple and direct in its operation.

In the event it is desired to use ammunition other than what is standard for the launcher as described, then the launcher is operated one shot at a time. This is with the presumption that the projectile which is not standard and not shown, has a nose portion such as C2 extending further out of its casing than the nose portion C2. A magazine is still being contemplated as being used and the magazine may be moved manually to position each round as the barrel is pumped forwardly.

With the use of standard ammunition, the magazine may be loaded or reloaded in two seconds and the three rounds held by a cartridge may be fired within three seconds giving it a rate of discharge of thirty-six rounds per minute which is submitted as being faster in being fired than the prior art competitive device. The magazine may be loaded blindly and does not require the vision which is needed to load rotating cylinders or the like.

It will of course be understood that various changes may be made in form, details, arrangement and proportions of the product without departing from the scope of the invention which, generally stated, consists in a product capable of carrying out the objects above set forth, in the parts and combination of parts disclosed and defined in the appended claims.

What is claimed is:

1. In connection with a multi-round hand operated grenade launcher, a pivotally connected upper and lower receiver, a barrel partially disposed into said upper receiver, means slidably retaining said barrel within said upper receiver, a stock and grip carried by said lower receiver, a magazine holding a plurality of rounds of grenade cartridges, said cartridges having casings disposed into said magazine and having nose portions of projectiles carried by said casings extending outwardly of said magazine, means limiting the sliding movement of said barrel to substantially the extent of said nose portions of said projectiles extending outwardly of said magazine, a passage receiving said magazine between said upper and said lower receivers, means carried by said upper receiver and said barrel actuated by the sliding movement of said barrel advancing said magazine through said passage, and said magazine being an operative extension of said barrel in cooperatively retaining a cartridge therebetween, said respective nose portions of said projectiles being received and retained in said barrel.

2. The structure of claim 1, wherein said first mentioned means comprises a track along an upper portion of said barrel, said track being partially T-shaped in cross-section and a track formed in the overlying upper wall portion of said upper receiver receiving and retaining said T-shaped track portion, and said second mentioned means comprises a slot in the track of said barrel and a pin depending from said upper receiver disposed into said slot.

3. The structure of claim 1, wherein said barrel has a track along an upper portion thereof having an open top slot in a portion thereof, said slot having an angled end portion, an elongated action bar pivoted to said upper receiver overlying said slot, said bar having a curved forward end portion, a pin depending from the outer end of said curved portion of said bar depending into and being guided by said slot, the other end portion of said bar being pivotally connected to said third mentioned means, whereby sliding movement of said barrel causes said pin to travel through said slot, the angled portion of which causes said action bar to advance said magazine.

4. The structure of claim 1, wherein said magazine has spaced notches in the upper surface thereof, said third mentioned means being adapted to respectively engage said notches responsive to a sliding movement of said barrel to advance said magazine, said notches being spaced to align with said barrel said cartridges carried by said magazine.

5. The structure of claim 1, wherein said magazine and said barrel have engaging surface portions, and said third mentioned means advances said magazine transversely of said barrel and respectively places the cartridges carried by said magazine in alignment with said barrel.

6. The structure of claim 1, wherein said magazine has a plurality of holes in its upper surface, a normally depending locating pin carried by said upper receiver, said holes respectively coming into register with said locating pin as each cartridge of said magazine is aligned with said barrel and receive said locating pin to hold said magazine until the cartridge is fired, and said third mentioned means is adapted to lift said locating pin from said hole for advancement of said magazine.

7. The structure of claim 1, wherein said first mentioned means comprises a track along said barrel having a lateral opening slot therein, an elongated latch member adjacent said slot, means pivoting said latch member to an overlying portion of said upper receiver whereby said latch member and said barrel have relative linear movement, means carried by the forward end portion of said latch member urging the same to be outwardly of said slot and causing the rearward portion of said latch member to be inward of said slot engaging the adjacent end wall of said slot and limiting the forward movement of said barrel, whereby said barrel is slidable forwardly by depressing into said slot said latch member.

8. The structure of claim 1, wherein said third mentioned means comprises a plate member, a recess in the bottom of said plate member, a second plate member carried in said recess, means pivoting securing said second plate member in said recess, means normally urging said second plate member outwardly of said recess, a pin upstanding from said first mentioned plate member, a transverse slot in said upper receiver having said first mentioned plate member disposed therein, said second mentioned plate member engaging the upper underlying surface of said magazine, and means actuated by the forward movement of said barrel engaging said pin to cause said second mentioned plate member to advance said magazine.

9. The structure of claim 1, wherein an edge portion of said casing extends into said barrel with said nose portion of said projectile.

* * * * *